US009218732B2

(12) United States Patent
Fiedler et al.

(10) Patent No.: US 9,218,732 B2
(45) Date of Patent: Dec. 22, 2015

(54) INTEGRATED FLOOD AND TEMPERATURE SENSOR FOR USE IN A HOME NETWORK ENVIRONMENT

(71) Applicant: Fibar Group sp. z o.o., Poznan (PL)

(72) Inventors: Maciej Fiedler, Poznan (PL); Bartlomiej Arcichowski, Poznan (PL); Jakub Hermanski, Wagrowiec (PL); Piotr Kurowski, Chodziez (PL); Adam Pudlowski, Kutno (PL)

(73) Assignee: Fibar Group S.A. (PL)

( * ) Notice: Subject to any disclaimer, the term of this patent is extended or adjusted under 35 U.S.C. 154(b) by 0 days.

(21) Appl. No.: 14/457,278

(22) Filed: Aug. 12, 2014

(65) Prior Publication Data

US 2015/0091723 A1 Apr. 2, 2015

Related U.S. Application Data

(60) Provisional application No. 61/897,946, filed on Oct. 31, 2013.

(30) Foreign Application Priority Data

Oct. 2, 2013 (PL) ..... 405519

(51) Int. Cl.
*G08B 19/00* (2006.01)

(52) U.S. Cl.
CPC ..... *G08B 19/00* (2013.01)

(58) Field of Classification Search
CPC ..... G08B 19/00; G08B 17/06; G08B 21/20
USPC ..... 340/521, 577, 584, 604, 605
See application file for complete search history.

(56) References Cited

U.S. PATENT DOCUMENTS 3,873,927 A 3/1975 Overall
4,297,683 A * 10/1981 Roberts ..... 340/539.31

(Continued)

FOREIGN PATENT DOCUMENTS

CA 70745 6/1992
CA 74034 3/1994

(Continued)

OTHER PUBLICATIONS

Galeev, Mikhail; "Catching the Z-Wave"; Electronic Engineering Times India; Oct. 2006; 5 pages.*

(Continued)

*Primary Examiner* — Benjamin C Lee
*Assistant Examiner* — Stephen Burgdorf
(74) *Attorney, Agent, or Firm* — McAndrews, Held & Malloy, Ltd.

(57) ABSTRACT

Methods and systems for an integrated flood and temperature sensor may comprise sensing a presence of water in a premises by measuring a resistance between at least one pair of metal probes in an integrated flood and temperature sensor, sensing a temperature utilizing one or more temperature sensors, and sensing an orientation of the integrated flood and temperature sensor with respect to gravity utilizing one or more level sensors. The metal probes may be extendable. The metal probes may be gold plated. A tamper sensor may sense whether an enclosure for the integrated flood and temperature sensor has been tampered with. The presence of water may be sensed utilizing a remote probe. The integrated water and temperature sensor may communicate wirelessly with one or more external devices utilizing a wireless transceiver.

18 Claims, 4 Drawing Sheets

(56) References Cited

U.S. PATENT DOCUMENTS

| | | | | |
|---|---|---|---|---|
| D301,869 | S | 6/1989 | Schwartz | |
| D325,902 | S | 5/1992 | Hudson et al. | |
| D334,561 | S | 4/1993 | Crater et al. | |
| D349,687 | S | 8/1994 | Khoo et al. | |
| D359,043 | S | 6/1995 | Althans | |
| D381,633 | S | 7/1997 | Hiyakumoto et al. | |
| 5,655,561 | A | 8/1997 | Wendel et al. | |
| D396,471 | S | 7/1998 | Kolinen | |
| D402,909 | S | 12/1998 | Stanuch | |
| D405,424 | S | 2/1999 | Winkler et al. | |
| D417,871 | S | 12/1999 | Hisatsune | |
| 6,526,807 | B1 * | 3/2003 | Doumit et al. | 73/40.5 R |
| D481,056 | S | 10/2003 | Kawasaki et al. | |
| D487,728 | S | 3/2004 | Murray | |
| D489,337 | S | 5/2004 | Murray | |
| D492,262 | S | 6/2004 | Murray | |
| D494,583 | S | 8/2004 | Guerrera | |
| 6,892,751 | B2 | 5/2005 | Sanders | |
| D513,497 | S | 1/2006 | Whitehouse | |
| D514,118 | S | 1/2006 | Christianson | |
| D520,500 | S | 5/2006 | Storti et al. | |
| D521,403 | S | 5/2006 | Shain et al. | |
| D523,873 | S | 6/2006 | Huang | |
| D533,186 | S | 12/2006 | Chen et al. | |
| D533,851 | S | 12/2006 | Yoon | |
| D540,752 | S | 4/2007 | Hayes et al. | |
| 7,206,645 | B2 | 4/2007 | Seguin | |
| D541,762 | S | 5/2007 | Nakagawa et al. | |
| D548,702 | S | 8/2007 | Girard | |
| 7,253,741 | B2 | 8/2007 | Fiorletta et al. | |
| 7,309,216 | B1 | 12/2007 | Spadola, Jr. et al. | |
| D559,233 | S | 1/2008 | Tang | |
| 7,343,264 | B2 * | 3/2008 | Tsigiroglou | 702/188 |
| D567,187 | S | 4/2008 | Oba et al. | |
| D570,297 | S | 6/2008 | Gibbons et al. | |
| D588,484 | S | 3/2009 | Bandringa et al. | |
| 7,522,036 | B1 * | 4/2009 | Preuss et al. | 340/531 |
| D604,254 | S | 11/2009 | Lanfear et al. | |
| D604,725 | S | 11/2009 | Chen | |
| D609,701 | S | 2/2010 | Hou | |
| D610,479 | S | 2/2010 | Shi | |
| D621,287 | S | 8/2010 | Kaneko et al. | |
| D631,165 | S | 1/2011 | Fisher et al. | |
| D631,446 | S | 1/2011 | Lanfear et al. | |
| D638,372 | S | 5/2011 | Clymer et al. | |
| D639,752 | S | 6/2011 | Li et al. | |
| D646,640 | S | 10/2011 | Clymer et al. | |
| D647,504 | S | 10/2011 | Choi | |
| 8,154,398 | B2 | 4/2012 | Rolf et al. | |
| D660,261 | S | 5/2012 | Huang et al. | |
| D660,809 | S | 5/2012 | Kern Koskela et al. | |
| D664,460 | S | 7/2012 | Aurongzeb et al. | |
| D665,290 | S | 8/2012 | Bhate et al. | |
| D665,773 | S | 8/2012 | Behringer | |
| D671,851 | S | 12/2012 | Treharne et al. | |
| D678,097 | S | 3/2013 | Elwell et al. | |
| D678,258 | S | 3/2013 | Seto | |
| D680,015 | S | 4/2013 | Hauser et al. | |
| D682,777 | S | 5/2013 | Gupta et al. | |
| D683,251 | S | 5/2013 | Dumas et al. | |
| D689,441 | S | 9/2013 | Kah, Jr. et al. | |
| D692,332 | S | 10/2013 | Ni et al. | |
| D693,311 | S | 11/2013 | Biller et al. | |
| D695,234 | S | 12/2013 | Santiago | |
| D695,693 | S | 12/2013 | Lee et al. | |
| D699,177 | S | 2/2014 | Higashi | |
| D703,156 | S | 4/2014 | Parsons et al. | |
| D703,566 | S | 4/2014 | Chen et al. | |
| D704,625 | S | 5/2014 | Tsutsumi et al. | |
| D705,719 | S | 5/2014 | Wong | |
| D706,152 | S | 6/2014 | Ni et al. | |
| D706,228 | S | 6/2014 | Ishiura | |
| 8,836,522 | B2 * | 9/2014 | Thorpe et al. | 340/628 |
| 8,860,568 | B1 * | 10/2014 | Baker | 340/517 |
| 2005/0225335 | A1 * | 10/2005 | Filipkowski | 324/696 |
| 2005/0248438 | A1 * | 11/2005 | Hughes et al. | 340/10.4 |
| 2007/0090059 | A1 * | 4/2007 | Plummer et al. | 210/743 |
| 2008/0027586 | A1 * | 1/2008 | Hern et al. | 700/284 |
| 2008/0133063 | A1 | 6/2008 | Bisson et al. | |
| 2009/0231129 | A1 | 9/2009 | Edwards et al. | |
| 2009/0240377 | A1 | 9/2009 | Batzler et al. | |
| 2011/0012726 | A1 | 1/2011 | Jessiman et al. | |
| 2011/0061014 | A1 | 3/2011 | Frader-Thompson et al. | |
| 2011/0077785 | A1 * | 3/2011 | Nickerson et al. | 700/284 |
| 2011/0093217 | A1 * | 4/2011 | Kates | 702/24 |
| 2011/0130880 | A1 | 6/2011 | Nishino et al. | |
| 2011/0289561 | A1 | 11/2011 | Ivanov et al. | |
| 2012/0074967 | A1 * | 3/2012 | Vokey et al. | 324/696 |
| 2012/0130513 | A1 | 5/2012 | Hao et al. | |
| 2013/0082835 | A1 | 4/2013 | Shapiro et al. | |
| 2013/0145826 | A1 | 6/2013 | Richarz et al. | |
| 2013/0241479 | A1 * | 9/2013 | Wright et al. | 320/109 |
| 2014/0005809 | A1 | 1/2014 | Frei et al. | |
| 2014/0058690 | A1 * | 2/2014 | Tian et al. | 702/62 |
| 2014/0118159 | A1 * | 5/2014 | Fish et al. | 340/870.01 |
| 2014/0201315 | A1 * | 7/2014 | Jacob et al. | 709/217 |

FOREIGN PATENT DOCUMENTS

| | | | |
|---|---|---|---|
| CA | 74569 | | 8/1994 |
| CA | 74610 | | 8/1994 |
| CN | 3274285 | | 1/2003 |
| CN | 301936325 | S | 5/2012 |
| CN | 201230432179X | | 6/2013 |
| CN | 302767627 | S | 3/2014 |
| DE | 4029615 | A1 | 4/1992 |
| EP | 0241676 | A2 | 10/1987 |
| EP | 000137351-0008 | | 2/2004 |
| EP | 000145644-0001 | | 3/2004 |
| EP | 000166350-0001 | | 4/2004 |
| EP | 000242888-0001 | | 10/2004 |
| EP | 000253380-0002 | | 11/2004 |
| EP | 000268032-0002 | | 12/2004 |
| EP | 000321971-0007 | | 4/2005 |
| EP | 000352943-0001 | | 6/2005 |
| EP | 000481304-0001 | | 2/2006 |
| EP | 000536438-0001 | | 5/2006 |
| EP | 000603709-0002 | | 10/2006 |
| EP | 000623608-0001 | | 11/2006 |
| EP | 000757620-0004 | | 7/2007 |
| EP | 000779061-0001 | | 8/2007 |
| EP | 000792791-0001 | | 9/2007 |
| EP | 000827118-0001 | | 11/2007 |
| EP | 000830542-0006 | | 11/2007 |
| EP | 000883269-0001 | | 2/2008 |
| EP | 001015788-0001 | | 10/2008 |
| EP | 001032437-0001 | | 11/2008 |
| EP | 001032437-0002 | | 11/2008 |
| EP | 001057392-0001 | | 12/2008 |
| EP | 001223457-0002 | | 6/2010 |
| EP | 001720590-0001 | | 6/2010 |
| EP | 001781188-0001 | | 11/2010 |
| EP | 001259204-0001 | | 2/2011 |
| EP | 001828070-0001 | | 2/2011 |
| EP | 001295182-0001 | | 9/2011 |
| EP | 001914029-0004 | | 9/2011 |
| EP | 001920018-0004 | | 9/2011 |
| EP | 002041764-0001 | | 5/2012 |
| EP | 002074989-0001 | | 7/2012 |
| EP | 002079673-0001 | | 7/2012 |
| EP | 002143784-0002 | | 11/2012 |
| EP | 002163360-0001 | | 1/2013 |
| EP | 002177667-0001 | | 2/2013 |
| EP | 002242800-0001 | | 5/2013 |
| EP | 002278887-0001 | | 7/2013 |
| EP | 002293415-0002 | | 8/2013 |
| EP | 002440198-0001 | | 4/2014 |
| EP | 002465476-0002 | | 5/2014 |
| JP | 1177905 | S | 6/2003 |
| JP | 1203574 | S | 4/2004 |
| JP | 1220720 | S | 10/2004 |
| JP | 1333401 | S | 6/2008 |
| JP | 1348157 | S | 1/2009 |
| JP | 1400836 | S | 11/2010 |

(56) References Cited

FOREIGN PATENT DOCUMENTS

| | | | |
|---|---|---|---|
| JP | 1422635 | S | 9/2011 |
| JP | 1463123 | S | 2/2013 |
| JP | 1491697 | S | 3/2013 |
| JP | 1386160 | S | 4/2013 |
| JP | 1471658 | S | 6/2013 |
| JP | 1475417 | S | 7/2013 |
| JP | 1477025 | S | 8/2013 |
| JP | 1477336 | S | 8/2013 |
| JP | 1400674 | S | 10/2013 |
| JP | 1498774 | S | 6/2014 |
| WO | DM053972 | | 11/2000 |
| WO | DM/058681 | | 11/2001 |
| WO | DM059634 | | 3/2002 |
| WO | 2004/066237 | A1 | 8/2004 |
| WO | DM066764 | | 5/2005 |
| WO | DM/074389 | | 9/2010 |
| WO | DM074708 | | 11/2010 |
| WO | DM075611 | | 12/2010 |
| WO | DM075517 | | 2/2011 |
| WO | DM076583 | | 5/2011 |
| WO | DM078408 | | 11/2011 |
| WO | DM079061 | | 2/2012 |
| WO | DM078643 | | 6/2012 |
| WO | DM078737 | | 7/2012 |
| WO | DM079877 | | 12/2012 |
| WO | DM081654 | | 8/2013 |
| WO | DM082066 | | 10/2013 |
| WO | DM083551 | | 2/2014 |

OTHER PUBLICATIONS

Automated Home, Case Study: UK Z-Wave Home Automation Setup, www.automatedhome.co.uk/installaton/case-study-uk-z-wave-home-automation-setup.html (13 pages), Jun. 17, 2014.

The Online Architecture and Design Exhibition, Interface Module for Home Automation System—EXB-REL8—AMX—Videos, www.archiexpo.com/prod/amx/interface-module-home-automation-systems-51274-1065061.html (18 pages), Jun. 17, 2014.

Graves On SOHO Technology, Vera Home Automation, Michael Graves, Oct. 23, 2008, www.mgraves.org/2008/10/vera-home-automation/ (6 pages), Jun. 17, 2014.

TaHomA—Home Motion by Somfy, Somfy Systems, Creator of TaHomA, the New Home Control System, www.somfytahoma.com/home-automation-products/home-automation-controllers-products/home-automation-somfy--tahoma-controller (3 pages), Jun. 17, 2014.

Introduction to X10 Home Automation Technology, by Tony Northrup, Jan. 10, 2005, www.oreillynet.com/pub/a/network/2005/01/10/x10_hmhck.html (5 pages), Jun. 17, 2014.

Fibaro Flood Sensor URL: http://www.fibaro.com/en/the-fibaro-system/flood-sensor.

Wireless Leakage Sensor URL: http://smarthome01.com/2014/03/03/wireless-leakage-sensor/.

Occupancy Sensor URL: http://www.tech-faq.com/occupancy-sensors.html.

Int'l Search Report and Written Opinion for PCT/IB2014/002978 dated Jun. 1, 2015.

* cited by examiner

INTEGRATED FLOOD AND TEMPERATURE SENSOR FOR USE IN A HOME NETWORK ENVIRONMENT

CROSS REFERENCE TO RELATED APPLICATIONS

This application makes reference to and claims priority to U.S. Provisional Application Ser. No. 61/897,946 filed on Oct. 31, 2013, which is incorporated herein by reference in its entirety. This application further makes reference to and claims priority to a Polish Patent Application No. 405519, filed on Oct. 2, 2013, which is incorporated herein by reference in its entirety.

FIELD

Certain embodiments of the invention relate to electronic systems. More specifically, certain embodiments of the invention relate to a method and system for an integrated flood and temperature sensor.

BACKGROUND

Existing systems for sensing environmental hazards in a premises can be costly, cumbersome, and inefficient. Further limitations and disadvantages of conventional and traditional approaches will become apparent to one of skill in the art, through comparison of such systems with the present invention as set forth in the remainder of the present application with reference to the drawings.

BRIEF SUMMARY

A system and/or method for an integrated flood sensor, substantially as shown in and/or described in connection with at least one of the figures, as set forth more completely in the claims.

Various advantages, aspects and novel features of the present invention, as well as details of an illustrated embodiment thereof, will be more fully understood from the following description and drawings.

DETAILED DESCRIPTION

Certain aspects of the invention may be found in a method and system for an integrated flood and temperature sensor. Exemplary aspects of the invention may comprise sensing a presence of water in a premises by measuring a resistance between at least one pair of the metal probes in an integrated flood and temperature sensor, sensing a temperature utilizing one or more temperature sensors in the integrated flood and temperature sensor, and sensing an orientation of the integrated flood and temperature sensor with respect to gravity utilizing one or more level sensors. The metal probes may be extendable from the integrated flood and temperature sensor. The metal probes may be gold plated. A tamper sensor may sense whether an enclosure for the integrated flood and temperature sensor has been tampered with. The presence of water may be sensed utilizing a remote probe coupled to the integrated flood and temperature sensor. The integrated water and temperature sensor may communicate wirelessly with one or more external devices utilizing a wireless transceiver in the integrated flood and temperature sensor. The one or more external devices may comprise at least one of: a home network manager, an alarm system, a handheld communication device, and a personal computer. The integrated water and temperature sensor may communicate with the one or more external devices utilizing a Z-Wave communications protocol and/or a wired connection.

As utilized herein the terms "circuits" and "circuitry" refer to physical electronic components (i.e. hardware) and any software and/or firmware ("code") which may configure the hardware, be executed by the hardware, and/or otherwise be associated with the hardware. As used herein, for example, a particular processor and memory may comprise a first "circuit" when executing a first plurality of lines of code and may comprise a second "circuit" when executing a second plurality of lines of code. As utilized herein, "and/or" means any one or more of the items in the list joined by "and/or". As an example, "x and/or y" means any element of the three-element set {(x), (y), (x, y)}. As another example, "x, y, and/or z" means any element of the seven-element set {(x), (y), (z), (x, y), (x, z), (y, z), (x, y, z)}. As utilized herein, the terms "block" and "module" refer to functions than can be implemented in hardware, software, firmware, or any combination of one or more thereof. As utilized herein, the term "exemplary" means serving as a non-limiting example, instance, or illustration. As utilized herein, the term "e.g.," introduces a list of one or more non-limiting examples, instances, or illustrations.

Figure 1:
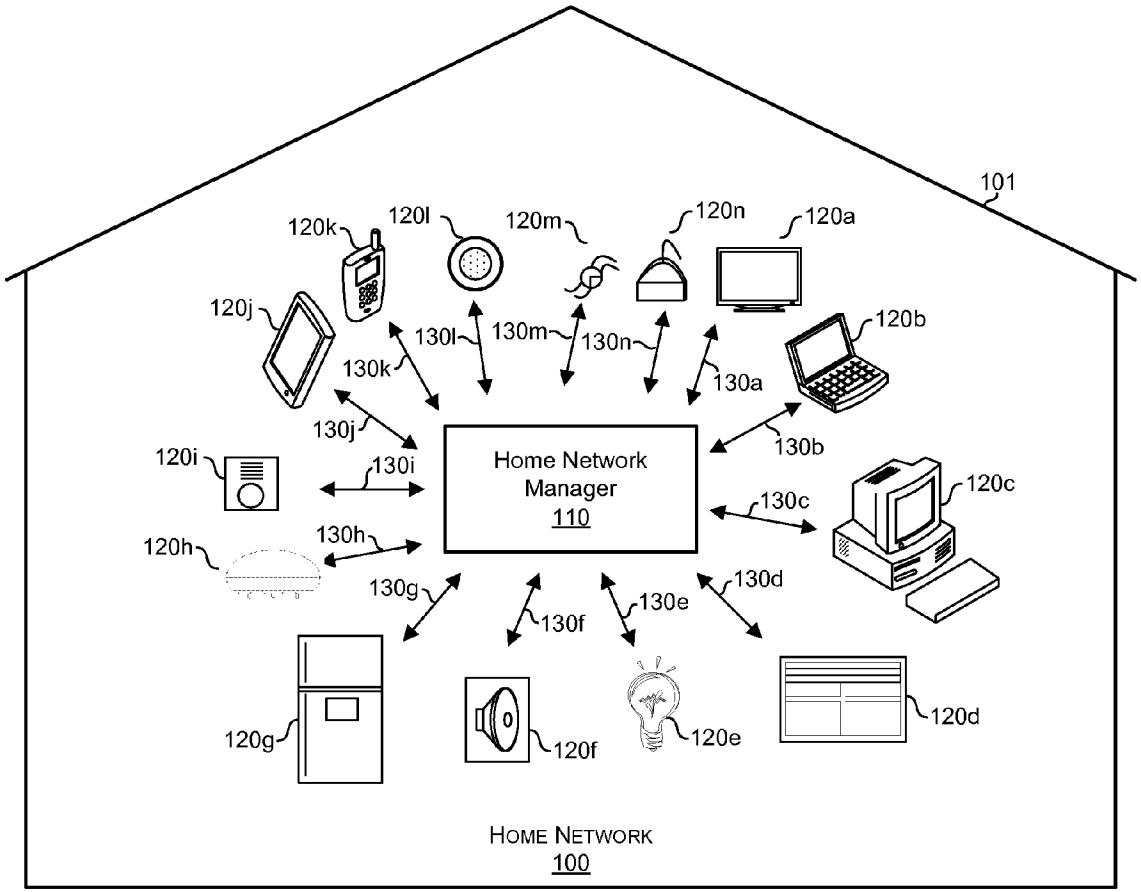
FIG. 1 is a diagram of an example home network, in accordance with an example embodiment of the disclosure.

FIG. 1 is a diagram of an example home network, in accordance with an example embodiment of the disclosure. Referring to FIG. 1, there is shown a home network 100. The home network 100 may correspond to a location 101. The location 101 may, for example, correspond to a residence (e.g., home, apartment) or non-residence premises (e.g., small business, school, library, factory, etc.). In this regard, the home network 100 may, for example, comprise a plurality of home network elements, such as, for example, a plurality of home network elements 120*a*-120*n*. The home network elements (e.g., home network elements 120*a*-120*n*) may, for example, comprise one or more devices, systems, fixtures, appliances, and/or other circuitry. The home network elements (e.g., home network elements 120*a*-120*n*) may comprise, for example, one or more televisions 120*a*, one or more computers (e.g., laptop computer 120*b*, desktop computer 120*c*), one or more personal and/or handheld devices (e.g., tablet 120*j*, mobile phone 120*k*, smart watch 120*m*), one or more multimedia devices and/or components (e.g., speakers 120*f*), one or more structural fixtures (e.g., windows/window blinds 120*d*,), one or more lighting and/or electrical fixtures 120*e*, one or more appliances (e.g., refrigerator 120*g*), one or more environmental sensors such as integrated flood/temperature sensor 120*h*, one or more security devices 120*i* (e.g., a smoke detector, a carbon monoxide detector, a security alarm, a motion detector), one or more sensors and/or controller (e.g., intelligent motion sensor 120*l*, RGBW controller 120*n*) and/or other devices.

The disclosure is not limited to any particular type of a home network. Furthermore, the disclosure is not limited to any particular combination of home network elements. It is to be understood that although the network is referred to as a "home network" throughout the disclosure, the disclosure is not limited in this way. Specifically, the network may comprise any other network that may be operable to control one or more network elements. For example, the network of the disclosure (whether or not referred to as a "home network") may be implemented in a residential, non-residential, commercial, industrial and/or any other setting. Similarly, the network elements may comprise network elements (whether or not referred to as a "home network elements") implemented in a residential, non-residential, commercial, industrial and/or any other setting.

In some instances, the home network 100 may incorporate a home network manager 110. The home network manager 110 may comprise suitable circuitry, interfaces, logic, and/or code for implementing various aspects of the present disclosure. For example, the home network manager 110 may be configured for use in managing, servicing, and/or interacting with one or more home network elements. Although the home network manager 110 is shown in FIG. 1 as a single and separate device, the disclosure is not limited in this way. For example, in some implementations, one or more functions of the home network manager 110 may be provided by one or more home network elements (e.g., providing user interface via tablet 120*j* and/or television 120*a*). In an example embodiment of the disclosure, the home network manager 110 may be implemented as a virtual platform, such as, for example, one or more software modules may run on, and/or utilize resources of one or more home network elements (e.g., laptop 120*b*, desktop 120*c*).

The home network manager 110 may be configured to communicate with one or more elements (e.g., home network devices, home network elements) in a home network. In an example embodiment of the disclosure, the home network manager 110 may be operable to communicate with one or more devices and/or systems that may be external to a home network, using, for example, optical, wired and/or wireless communication links.

Although the home network manager 110 is illustrated as a single device, the disclosure is not limited in this way. For example, the home network manager may comprise one or more home network manager that may each interact with one or more home network elements (e.g., home network elements 120*a*-120*n*). In an example embodiment of the disclosure, each of the one or more home network managers may be associated with particular one or more home network elements. In another example, one or more of the one or more home network managers may be associated with any one or more home network elements (e.g., home network elements within range of a particular home network manager, with best communication path).

In an example embodiment of the disclosure, the home network manager 110 may be implemented in an integrated or a distributed system. An integrated system may be implemented, for example, on one computer, server, machine or device, where the integrated system may be configured to perform some or all of the functions, features and/or operations of the home network manager 110 as described herein. A distributed system may be implemented with multiple components (e.g., computers, servers, machines and/or devices), where each of the multiple components may be configured to perform some or all of the functions, features and/or operations of the home network manager 110 as described herein. Each function, feature and/or operation may be implemented on one or more of the components of the distributed system. For example, a specific feature, function and/or operation may be implemented only one component of the distributed system or it may be implemented across multiple components of the distributed system.

In an example embodiment of the disclosure, in addition to or instead of the use of one or more home network managers, the home network 100 may comprise one or more master controllers for controlling one or more home network elements. A master controller may be pre-programmed and/or programmable to control one or more home network elements. A master controller may comprise, for example, a remote controller.

Although the disclosure may refer to a single home network manager, it is to be understood that the disclosure is not limited in this way. For example, the home network manager may comprise one or more home network managers that individually and/or in the aggregate may be implemented as integrated and/or a distributed system.

The home network manager 110 may interact with one or more of the home network elements 120*a*-120*n* via corresponding links 130*a*-130*n*, which may be supported by the home network manager 110 and/or the corresponding home network element(s). For example, the links 130*a*-130*n* may be implemented and/or configured to operate using a wireless protocol, such as, for example, a Z-wave protocol. In an example embodiment of the disclosure, the home network 100 may be implemented as Z-Wave network. However, the disclosure is not limited in this way. For example, the home network 110 may comprise one or more wired and/or wireless links and/or protocol. Wireless links and/or protocols, may comprise, for example, WPAN (e.g., Bluetooth or ZigBee), low power links (e.g., Bluetooth LE (BLE), Bluetooth Smart, iBeacon), near field communication protocols (e.g., NFC) and/or WLAN (WiFi/802.11) protocols and/or any other wireless links and/or protocols suitable for implementation consistent with the disclosure. Wired protocols and/or links may comprise, for example, Ethernet, Universal Serial Bus (USB), and/or any other wired links and/or protocols suitable for implementation consistent with the disclosure.

In an example embodiment of the disclosure, home network manager 110 may interact with one or more home network elements (e.g., home network elements) directly and/or indirectly. For example, the home network manager 110 may interact with one or more home network elements directly through a corresponding link (e.g., wireless, wired link/connection).

In another example, the home network manager 110 may interact with one or more home network elements indirectly though, for example, a converter (e.g., global cache). In this regard, the home network manager 110 that supports one or more particular network interfaces and/or other interfaces (e.g., USB) may be operable to interact with a particular network element (and/or another device) that may otherwise be incompatible with one or more of the one or more particular network and/or other interfaces supported by the home network manger 110. The interaction may be achieved though, for example, a converter and/or a translator. The converter and/or the translator may each comprise suitable logic, circuitry, interfaces, and/or code that may be operable to facilitate communication between a home network manager (e.g., the home network manger 110) and a home network element (home network elements 120*a*-120*n*).

In another example, the home network manager 110 may interact with one or more home network elements indirectly though, for example, other network elements. In this regard, the home network manager 110 may interact with one or more home network elements on, for example, a mesh network. An example mesh network (not shown) may facilitate communication (e.g., transmission of messages, signals, data frames) to and/or from the home network manager (e.g., the home network manager 110) to and/or from a particular network element where the communication may, for example, pass through one or more other network elements before reaching the particular network element and/or the home network manager.

In an example embodiment of the disclosure, the home network manager 110 may be operable to support one or more communication methods from one or more other home network devices (e.g., home network elements 120*a*-120*n*). For example, one or more home network elements may communicate with the home network manager 110 utilizing a particular wireless link and/or protocol (e.g., Z-wave) and/or a particular wired link and/or protocol (e.g., Ethernet), while one or more other home network elements may communicate with the home network manager 110 utilizing a different particular wireless link and/or protocol (e.g., WiFi) and/or a different particular wired link and/or protocol (e.g., USB).

In an example embodiment of the disclosure, the same one or more home network elements may communicate with the home network manager 110 by, for example, using one or more wired and/or wireless links and/or protocols at the same and/or at different times. For example, a particular network element may communicate with the home network manager 110 using a Z-Wave communication protocol for a particular communication and may communicate with the home network manager 110 using a WiFi communication protocol for another particular communication.

In an example embodiment of the disclosure, one or more home network elements (e.g., home network elements 120*a*-120*n*) may communicate with one or more home network elements (e.g., home network elements 120*a*-120*n*) directly. In this regard, the one or more network elements may utilize one or more communication links (e.g., wireless, wired) (not shown) and/or one or more network interfaces and/or other interfaces without directing (e.g., routing the communication through, for example, a home network manager (e.g., the home network manger 110). For example, a home network element may be operable to detect existence of one or more other network elements (e.g., on the same and/or different network) and may initiate, send and/or receive communication to and/or from the one or more other network elements.

In an example embodiment of the disclosure, one network element may be out of range of a home network manager and may communicate with one or more other network elements to determine whether the one or more other network elements are within range of a particular (e.g., a home network manager previously within range of the one network element) and/or any network manager. The range detection and/or discovery may continue from one network element to another. For example, a particular home network element may need to communicate through more than one other home network element in order to, for example, communicate with a desired home network element and/or a desired, particular and/or any home network manager (e.g., the home network manager 110). The disclosure is not limited to a communication for a purpose of range discovery/detection. The communication may comprise any type of communication and may be used for a variety of other purposes (e.g., communicating with a different network element, communicating with a home network manager, controlling an out of range device, controlling another network element).

In an example embodiment of the disclosure, one or more home network elements (e.g., home networks elements 120*a*-120*n*) may be operable to control one or more other home network elements (e.g., home networks elements 120*a*-120*n*) with and/or without intermediary, such as, for example, a home network manager (e.g., home network manager). For example, one or more home network elements may be operable to control one or more other home network elements through an intermediary. In this regard, a particular network element may communicate with an intermediary (e.g., home network manager) in order to communicate with and/or to control another home networks element. An intermediary may comprise one or more devices (e.g., a preprogrammed and/or programmable master controller, home network manager) that may be operable to control one or more network elements. In another example, a particular network element may directly communicate with and/or to control another home networks element.

In an example embodiment of the disclosure, one or more home network elements (e.g. home network elements 120*a*-120*n*) and/or other devices that may be operable to communicate on the network (and/or an associated network as described herewith) and/or that may not be operable to communicate on the network but may otherwise be tractable (e.g., GPS, iBeacon, electronic tag), with one or more other network elements, devices and/or a network manager (e.g., home network manager 110) associated with a particular network (e.g., home network 100) (and/or an associated network as described herewith), may communicate with each other, other devices (e.g., on the same network, another network and/or otherwise connected and/or tractable) and/or the network manager, and/or may be operable to determine a precise location of a particular network element, device and/or network manager utilizing various communication protocols and/or interfaces.

For example, one or more network elements (and/or other devices operable on the network, an associated network as described herewith and/or otherwise traceable) may be operable to generate and/or receive information and/or one more signals and/or messages that may be utilized in determining a location of a particular network element, device and/or network manager. In this regard, a near field communication and/or a low power interface protocol (e.g., BLE, iBeacon) may be utilized for communication between the elements, devices and/or network managers. Furthermore, one more tags (e.g., small electronic devices) may be utilized, to facilitate location of particular elements, devices and/or network managers. For example, a network element, device and/or home network manager may generate a signal and/or a message (on the network, on an associated network and/or through a built in, external, portable and/or otherwise attachable tag) that may be received by another network element, device and/or network manager.

In an example embodiment of the disclosure, one or more home network elements, devices and/or manager may cooperate (e.g., exchange information) to, for example, collectively and/or individually determine a precise location of a particular network element, device and/or network manager based on the received one or more signals and/or messages. As an example only, a particular network element, device and/or home network manager may generate a signal and/or a message that may be received by other network element, device and/or home network device within a particular time frame. The information about the time it took to, for example, receive the particular one or more signals and/or messages (and/or the information gather from the one or more signals and/or messages, such as, for example, signal strength) may be used to determine the precise location (e.g., distance to/from the network element, device, network manager that received the particular one or more signals and/or message) of the particular network element, device and/or network manager.

In operation, the home network manager 110 may be operable to manage a home network (e.g., the home network 100). The home network manager 110 may be utilized, for example, as an interface platform for interacting with various network elements (e.g., the home network elements 120*a*-120*n*). In this regard, the home network manager 110 may support establishing and/or configuring one or more communication connections/links (e.g., the links 130*a*-130*n*) with the one or more elements of the home network 110. Once established, the connectivity between the home network manager 110 and the home network elements (e.g., elements 120*a*-120*n*) may, for example, be utilized to enable centralized monitoring, control, and/or management of the home network elements, and/or of the home network 100 as a whole. For example, the home network manager 110 may be operable to control operations of certain elements (e.g., turn on television 120*a*, switch to particular channel(s) at particular days/times, and/or record if recording is supported); monitor environment in the home network, such as by obtaining environmental readings (e.g., such as flooding or excessive temperature increase due to fire) via the integrated flood and temperature sensor 120*h*, and may process these readings (e.g., to determine if/when to adjust other home network elements accordingly and/or to alert the home residents); adjust one or more example lighting and/or electrical fixtures 120*e* (e.g., turn lights on or off); lower/raise example window (blinds) 120*d;* adjust operations of example appliances (e.g., refrigerator 120*g*), such as, for example, based on a preconfigured power efficiency/optimization profile; monitor for any indications of a security/safety problem, based on, for example, input from example security devices 120*i*, and/or act accordingly (e.g., send notifications to users, such as by texting example smartphone 120*k*, and/or automatically notify authorities, e.g., by dialing '911' and/or contacting preconfigured emergency numbers).

In an example embodiment of the disclosure, the home network manager 110 may provide and/or utilize user interface services in the home network. In this regard, the home network manager 110 may be operable to support use of user interface functions, and/or to generate and/or store information corresponding thereto, which may be utilized to enable interactions between the home network manager 110 and users (e.g., in the home network 100). For example, in some implementations, the home network manager 110 may be configured to generate and/or use a graphic user interface (GUI), for visually displaying information and/or providing interactivity with users (e.g., for providing input thereby). One or more user interfaces may enable configuring the home network manager 110 and/or functions provided by the home network manager 110. In an example embodiment of the disclosure, the one or more user interfaces may enable user interaction with, configuring and/or adjusting other elements in the home network 100 (e.g., elements connected to the home network manager 110).

In an example embodiment of the disclosure, the user interfaces may be provided via one or more other devices that may be communicatively coupled to the home network manager 110. For example, a GUI generated and/or used by the home network manager 110 may be displayed using existing home network elements, such as, for example, television 120*a*, laptop 120*b*, tablet 120*j*, and/or smartphone 120*k*.

The disclosure is not limited to a single network (e.g., home network 100) and/or a single network manager (e.g., home network manager 110). For example, one or more networks (e.g., home network 100) and/or one or more network managers (e.g., home network manager 110) may be grouped together. The grouping may correspond to one or more locations (e.g., location 101).

In an example embodiment of the disclosure, a network (e.g., home network 100) may be associated with one or more network managers (e.g., home network manager 110). For example, one network manager may be associated with one or more networks (e.g., home network 100) and/or locations (e.g., location 101).

In an example embodiment of the disclosure, a grouping of networks may comprise one or more network, network managers and/or locations. The grouping may be programmable and/or configurable. For example, one more networks may be defined, one or more network managers may be assigned per network and/or associated with one or more devices with a network and/or a network manager. In this regard, the information may be shared between the different networks, network managers and/or devices assigned to the different networks and/or network managers. For example, information gathered on one network (e.g., by a network device, through an occurrence of a condition, event, an alarm, and/or other predefined and/or preconfigured condition) may cause the information to be communicated on the same and/or another associated network. In this regard, the information may trigger a condition, an alarm, an occurrence of an event and/or any other predefined and/or preconfigured condition (e.g., operation of a device, network element) on the same and/or another associated network.

In an example embodiment of the disclosure, the home network 100 (and various components thereof, particularly the home network manager 110) may be configured to support use of integrated flood and temperature sensors (e.g., the integrated flood and temperature sensor 120*h*). In this regard, an integrated flood and temperature sensor 120*h* may be operable to sense when the home is flooding and/or water is leaking from water pipes, for example, and or when the temperature has risen suddenly in the home due to a fire. This information may be utilized to trigger an alarm system, such as one of the security devices 120*i*, shut off water supply lines, and/or notify the home resident/owner and/or authorities in case of a fire, so that corrective action may be taken. A temperature sensor may be operable to manage a heating and/or cooling system. An example integrated flood and temperature sensor is depicted in and/or described with respect to FIG. 2.

Figure 2:
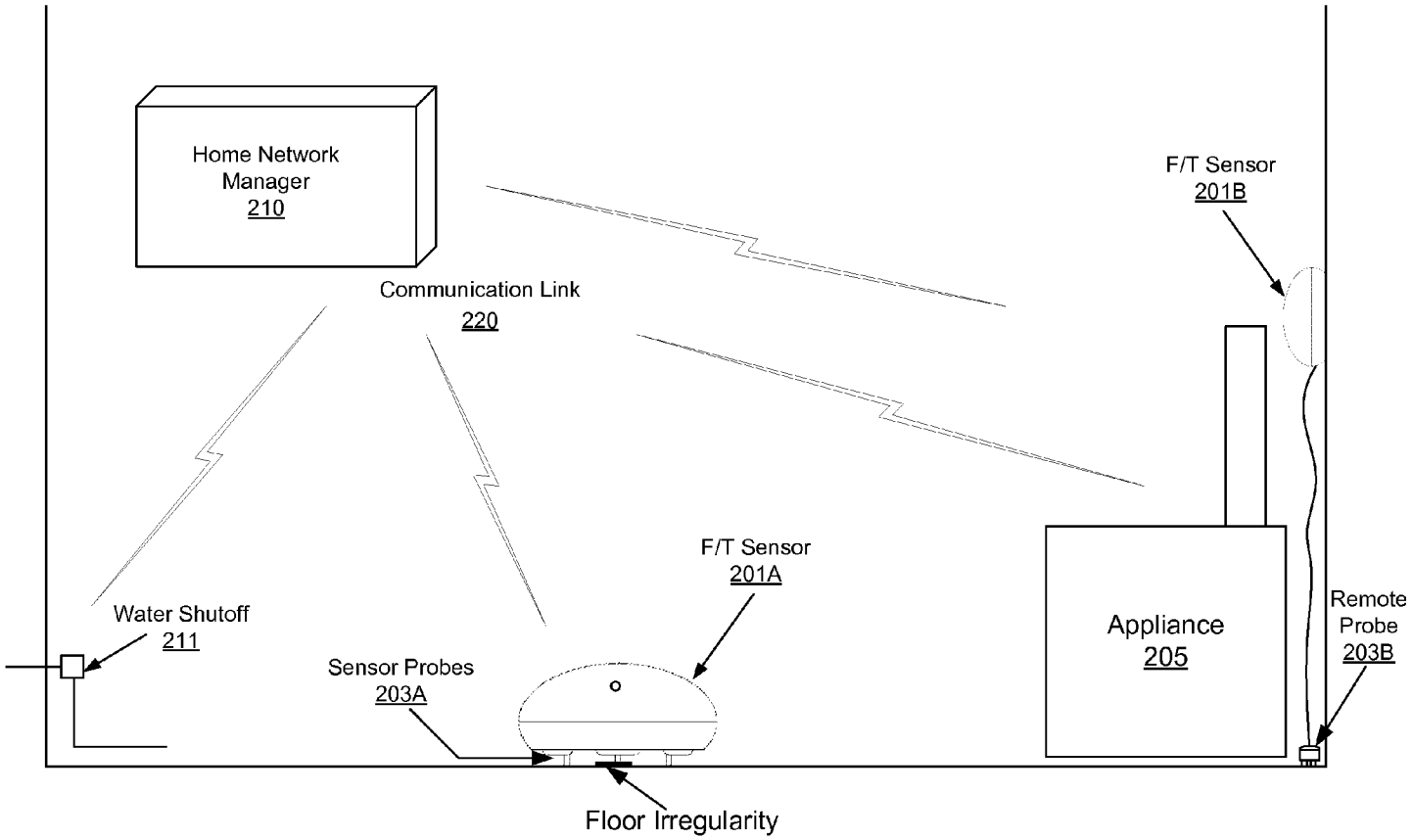
FIG. 2 is a diagram illustrating an example networked integrated flood and temperature sensor, in accordance with an example embodiment of the disclosure.

FIG. 2 is a diagram illustrating an example networked integrated flood and temperature sensor, in accordance with an example embodiment of the disclosure. The integrated flood and temperature sensors 201A and 201B illustrate different example scenarios and may comprise sensors for detecting the presence of water as well as the environmental temperature, as described for the integrated flood and temperature sensor 120*h* in FIG. 1. The home network manager 210 may be similar to the home network manager 110 described with respect to FIG. 1.

The integrated flood and temperature sensor 201A, 201B may be configured for operation on a home network (e.g., home network 100 as depicted in and/or described with respect to FIG. 1), such that, the integrated flood and temperature sensor 201A, 201B may be utilized as a home network element. In this regard, integrated flood and temperature sensor 201A, 201B may be configured to interact, for example, in a home network (e.g., home network 100 as depicted in and/or described with respect to FIG. 1) with, for example, a home network manager (e.g., home network manager 210). The home network manager may be substantially similar to the home network manager 110 as depicted in and/or described with respect to FIG. 1.

The integrated flood and temperature sensor 201A, 201B may be configured to interact with the home network manager 210 via, for example a communication link 220. The communication link 220 may, for example, comprise a Z-Wave link. The disclosure is not limited to any particular type of a communication link. For example, the integrated flood and temperature sensor 201A, 201B may be implemented to support, for example one or more wireless and/or wired links, protocols and/or connections. For example, wireless links, protocols and/or connections, may comprise, for example, WPAN (e.g., Bluetooth or ZigBee) and/or WLAN (WiFi/802.11) protocols and/or any other wireless links, protocols and/or connections suitable for implementation consistent with the disclosure. Wired links, protocols and/or connections may comprise, for example, Ethernet, Universal Serial Bus (USB), and/or any other wired links, protocols and/or connections suitable for implementation consistent with the disclosure. While not shown in FIG. 2, to support communication with other elements or systems, such as the home network manager 210, the RGBW controller 200 may incorporate a communication transceiver (e.g., a Z-Wave transceiver) and/or related processing resources for allowing use of the RGBW controller 200.

In en example embodiment of the disclosure, the integrated flood and temperature sensor 201A, 201B may comprise an internal and/or an external antenna for communicating with other devices (e.g., devices on the network, network elements 120*a*-120*n*, home network manager 210).

In an example embodiment of the disclosure, the integrated flood and temperature sensor 201A, 201B may provide wired and/or wireless interfaces that may enable one or more network devices to connect to a home network (e.g., home network 100) and/or home network manager (e.g., home network manager 210). For example, if the network manager provides connectivity of various devices to a home network, for example, based on a Z-Wave protocol, the integrated flood and temperature sensor 201A, 201B may, for example, contain suitable circuitry, interfaces, logic, and/or code that may enable a particular device that, for example, may not be compatible with the example Z-Wave protocol (and/or any other particular protocol that the network manager supports) to connect to the network manager and/or the home network. For example, the integrated flood and temperature sensor 201A, 201B may allow for monitoring of sensor devices (e.g., sensor device(s) 233) that may otherwise be incompatible of being monitored on a particular home network and/or by a particular network manager.

In an example embodiment of the disclosure, the integrated flood and temperature sensor 201A, 201B may comprise one or more input/output ("I/O") interfaces. The I/O interface may comprise suitable logic, circuitry, interfaces, and/or code that may be operable to enable user interactions with the integrated flood and temperature sensor 201A, 201B through interfaces. The I/O interface may obtain input from user(s) of the integrated flood and temperature sensor 201A, 201B and/or provide output to the user(s). The I/O interface may support various types of inputs and/or outputs, including, for example, video, audio, and/or textual. In this regard, dedicated I/O devices and/or components, external to or integrated within the integrated flood and temperature sensor 201A, 201B, may be utilized for inputting and/or outputting data during operations of the I/O interface. Exemplary (external or integrated) I/O devices may comprise displays, mice, keyboards, touchscreens, voice input interfaces, and other input/output interfaces or devices.

Example interface devices may, for example, provide a graphical user interface (GUI) for controlling the operation of one or more integrated flood and temperature sensors (e.g., integrated flood and temperature sensor 201A, 201B).

In an example embodiment of the disclosure, the integrated flood and temperature sensor 201A, 201B may be operable to communicate with a network manager (e.g., home network manager 210). The integrated flood and temperature sensor 201A, 201B may communicate, to the network manager, information and/or data relating to, for example, status of the integrated flood and temperature sensor 201A, 201B, one or more devices that may be controlled and/or monitored by and/or connected to the integrated flood and temperature sensor 201A, 201B. The communications may comprise status information, predefined and/or predetermined conditions and/or any other information that may be relevant to the operation of the integrated flood and temperature sensor 201A, 201B and/or other devices that may be controller and/or monitored by and/or connected to the integrated flood and temperature sensor 201A, 201B, the and/or any other information that may be relevant to the operation of a home network. The status and/or predefined and/or predetermined conditions may comprise status and/or alarm conditions associated with operation of one or more integrated flood and temperature sensor 201A, 201B and/or any other information.

In an example embodiment of the disclosure, the integrated flood and temperature sensor 201A, 201B may also receive communications from the network manager. The communications may, for example, comprise information relating to predefined and/or predetermined conditions and/or information comprising commands that may be executed on the integrated flood and temperature sensor 201A, 201B.

In an example embodiment of the disclosure, the integrated flood and temperature sensor 201A may comprise sensor probes 203A, which may be extendable metal probes. In an example scenario, the sensor probes 203A may be gold plated for accurate impedance measurements for the detecting the presence of water. In addition, the sensor probes 203A may extend in or out of the flood and temperature sensor 201A so that it may stay level even with the presence of floor irregularities, as shown in FIG. 2.

In an example embodiment of the disclosure, the integrated flood and temperature sensor 201A may also comprise a temperature sensor. In instances where a large temperature rise, or fall, is sensed, an alarm may be sounded and/or a notification may be sent to the home network manager 210, which may relay the message to an alarm system, for example. A notification may be sent to the handheld device of an owner/tenant of the residence so that appropriate action may be taken. The temperature sensor 201A may be utilized to, for example, provide information to and/or control a heating and/or cooling system (e.g., thermostat, heated surfaces systems, such as for example, heated floors system). Although the present disclosure referrers to an integrated flood and temperature sensor, the disclosure is not limited in this way. For example, the temperature sensor may be optional.

The integrated flood and temperature sensor 201B may be substantially similar to the integrated flood and temperature sensor 201A, but in an alternative configuration, mounted to the wall and with a lead to a remote probe 203B, which may be substantially similar to the sensor probes 203A, but placed remotely from the sensor. The remote probe 203B may be utilized in areas where it may be difficult to access, such as behind a large appliance, the appliance 205, for example, or other household structure. The remote probe 203B may be wired and/or wireless. In an example embodiment of the disclosure, the remote probe 203B may be included as part of another home network element and/or another device that may be operable to communicate with the integrated flood and temperature sensor 201B, a home network manager and/or another home network element.

The integrated flood and temperature sensors 201A and 201B may be operable to sense their locations, though, for example, GPS, IPS and/or micromapping positioning, and/or based on a positioning signal communicated with the home network manager 210 and/or another network element, for example, so that if the sensors are moved from their desired location, a notification may be sent to the home network manner, another home network element and/or a homeowner or resident. In instances where an alarm condition has been sensed, such as a flood, or large temperature change, the integrated flood and temperature sensors 201A and 201B may communicate a notification to the home network manager 210 which may relay a message to other devices, such as the water shutoff valve 211 or the appliance 205, to stop further flooding, for example.

Figure 3:
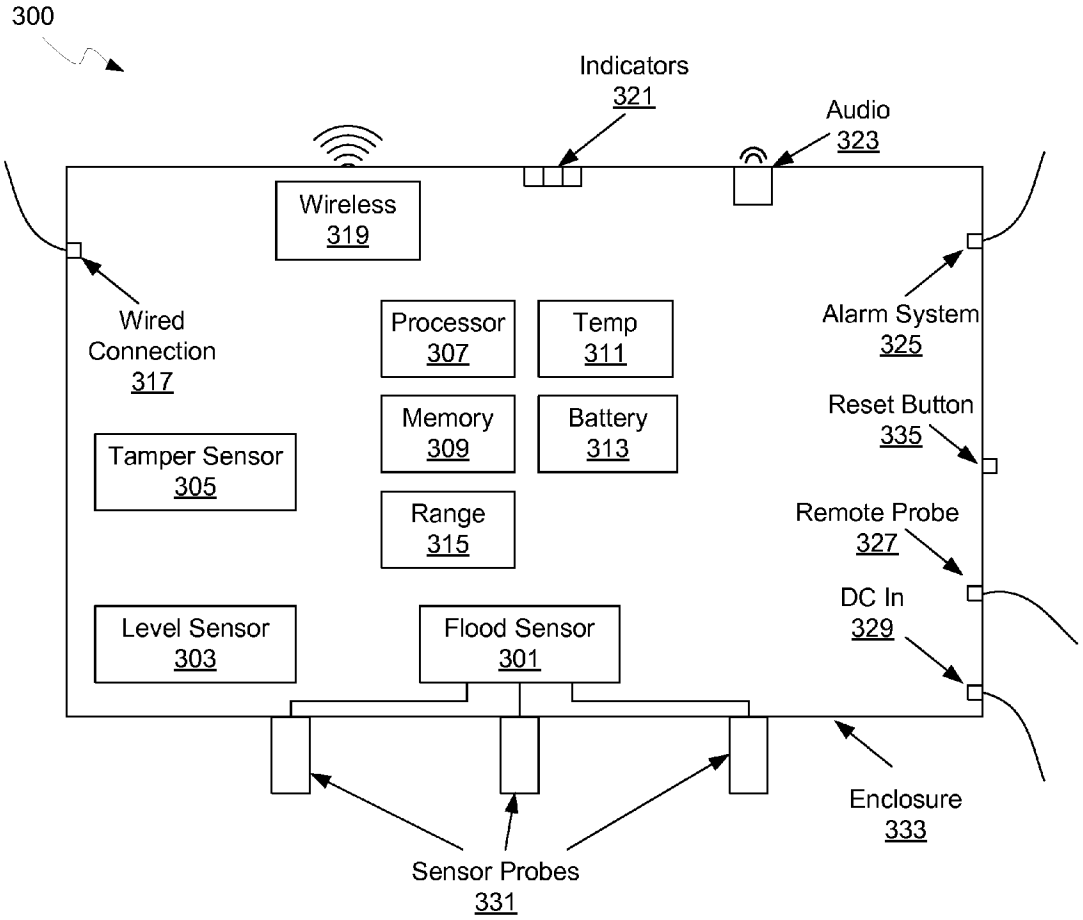
FIG. 3 is a block diagram illustrating an example integrated flood and temperature sensor, in accordance with an example embodiment of the disclosure.

FIG. 3 is a block diagram illustrating an example integrated flood and temperature sensor, in accordance with an example embodiment of the disclosure. Referring to FIG. 3, there is shown an integrated flood and temperature sensor 300 comprising a flood sensor 301, a level sensor 303, a tamper sensor 305, a processor 307, memory 309, a temperature sensor 311, a battery 313, a wireless range tester sensor 315, a wired connection 317, a wireless transceiver 319, indicators 321, an audio output 323, an alarm system connection 325, a remote probe connection 327, a DC voltage input connection 329, sensor probes 331, and an enclosure 333. While FIG. 3 shows separate functional components, many of the functional blocks shown in FIG. 3 may be integrated on one or more integrated circuits or may comprise a combination of discrete devices and integrated circuits.

The flood sensor 301 may comprise suitable circuitry, logic, and/or code that may be operable to measure impedances between the sensor probes 331 for determining the presence of water. In instances when water is leaking from a water line or leaking through the structural foundation of a home, the resistance between the sensor probes may drop significantly when they become in contact with the encroaching water. The sensor probe 331 may comprise extendable and retractable metal probes that support the integrated flood and temperature sensor 300 on the floor and the impedance between them may be utilized to determine the presence of water. While three probes are shown, other numbers of probes may be utilized, depending on the size of the integrated flood and temperature sensor 300.

Although the present dissolute refers throughout to the ability of the integrated flood and temperature sensor (e.g., integrated flood and temperature sensors 201A and 201B) to be able to detect water (e.g., through a flood sensor 301), the disclosure is not limited in this way. Specifically, the integrated flood and temperature sensor of the present disclosure (e.g., integrated flood and temperature sensors 201A and 201B) may be operable to detect other liquids, such as, for example, alcohol, oil, and may be operable to distinguish between the various types of liquids based on, for example, the liquid's density and/or other properties.

The level sensor 303 may comprise a micro electro-mechanical system (MEMS) sensor, for example, that may sense the orientation of the integrated flood and temperature sensor 300 with respect to gravity. Accordingly, in an example scenario, the level sensor 303 may comprise arrays of MEMS cantilevers orientated along different axes, and may be operable to sense when the integrated flood and temperature sensor 300 is not horizontal, such that the sensor probes 331 cannot make necessary contact with the floor for water sensing. When the level sensor 303 determines that the integrated flood and temperature sensor 300 is not sufficiently horizontal, an alarm may sound and/or send an indication to a home network manager and/or mobile device of the homeowner/resident.

The tamper sensor 305 may comprise suitable circuitry, logic, and/or code that may be operable to sense when an enclosure, the enclosure 333 of the integrated flood and temperature sensor 300, has been tampered with, such as being pried open to access the circuitry within. The tamper sensor 305 may comprise one or more switches mounted on the enclosure 333 that may close, or open, when the enclosure 333 is opened. Since the integrated flood and temperature sensor 300 may occasionally be subjected to water, it may be beneficial to be water tight, and tampering with the enclosure 333 may negatively impact the water tightness. While the enclosure 333 is shown as being rectangular in shape, this is not necessarily the case. In this regard, the integrated flood and temperature sensor 300 may generate a temper alarm condition. The condition may be communicated on the home network (e.g., home network 100), to other devices and/or a home network manager (e.g., home network manager 210).

The processor 307 may comprise suitable logic, circuitry, and/or code that may enable control and/or data processing operations for the integrated flood and temperature sensor 300. The processor 307 may be utilized to control at least a portion of the various functional blocks such as the wireless transceiver 319, the flood sensor 301, the tamper sensor 305, the wireless range tester 315, the temperature sensor 311, and/or the memory 309. In this regard, the processor 307 may generate at least one signal for controlling operations within the integrated flood and temperature sensor 300.

The memory 309 may comprise suitable logic, circuitry, and/or code that may enable storage of data and/or other information utilized by the integrated flood and temperature sensor 300. The memory 309 may store, for example, configuration data, which may comprise parameters and/or code, comprising software and/or firmware. The memory may comprise different memory technologies, including, for example, read-only memory (ROM), electrically erasable programmable ROM (EEPROM), random access memory (RAM), low latency nonvolatile memory, flash memory, solid-state drive (SSD), field-programmable gate array (FPGA), and/or other suitable electronic data storage capable of storing data, code and/or other information.

For example, the memory 309 may be utilized for storing processed data generated by the flood sensor 301, the level sensor 303, the temperature sensor 311, and/or the processor 307. The memory 309 may also be utilized to store information, such as configuration information, that may be utilized to control the operation of at least one block in the integrated flood and temperature sensor 300. For example, the memory 309 may comprise information necessary to configure the wireless transceiver 319 to enable receiving RF signals in the appropriate frequency band and of a desired communications protocol.

In an example embodiment of the disclosure, the integrated flood and temperature sensor 300 may be operable to receive software and/or firmware updates that may be stored in a memory (e.g., memory 309). For example, the integrated flood and temperature sensor 300 may receive software and/or firmware updates from a network manager (e.g., the home network manager 210). In an example embodiment of the disclosure the software and/or hardware updates may be received, processed and/or installed automatically and/or manually. For example, the process may be completely automatic (e.g., a network manager may send an update to the integrated flood and temperature sensor 300 and the integrated flood and temperature sensor 300 may process it automatically), and/or semi-automatic (e.g., an update may be initiated by a user through, for example, a network manager, and may, for example, be processed by the integrated flood and temperature sensor 300 automatically).

The temperature sensor 311 may comprise one or more sensors for determining the temperature in or near the integrated flood and temperature sensor 300. In this manner, the integrated flood and temperature sensor 300 may sense when a fire has started or when temperature drops due to a home heating system failure and pipes may be in danger of bursting, thereby possibly averting the need to sense leaking water. The temperature may be sensed on a regular basis to record temperature versus time, such that deviations from normal variations may be detected.

The battery 313 may comprise a replaceable battery within the integrated flood and temperature sensor 300 for providing power, or for backup power when a DC input voltage is utilized. The integrated flood and temperature sensor 300 may make sensor measurements and/or communicate with other devices less frequently when powered by the battery 313 only and may sense/communicate continuously when utilizing an external DC power source.

The wireless range tester 315 may comprise suitable circuitry, logic, and/or code that may be operable to, for example, determine whether the integrated flood and temperature sensor 300 is within a range of a home network manager (e.g., home network manager 210) and/or other network element. In this regard, the wireless range tester 315 may be operable to generate an alarm condition when the integrated flood and temperature sensor 300 is not within a range of any home network manager (e.g., home network manager 210) and/or other network element and/or when the integrated flood and temperature sensor 300 that, for example, was previously within the range of a (e.g., home network manager 210) and/or other network element, is now outside of that range. In an example embodiment of the disclosure, the alarm condition may active one or more alarm indicators to generate an alarm condition by, for example, generating an audible and/or a visual alarm (e.g., an alarm may sound from the audio output 323, the indicators 321 may light up in alarm, and a message may be sent to a home network manager so that appropriate action may be taken).

In another example embodiment of the disclosure, wireless range tester 315 may indicate whether the integrated flood and temperature sensor 300 is in range, is in an intermediate range and/or is out of range of a home network manager. The in range indication may, for example, be associated with a condition where the integrated flood and temperature sensor 300 may establish a direct connection with a home network manager (e.g., home network manager 210) and whether or not a direct communication is desirable (e.g., the integrated flood and temperature sensor 300 may, for example, communicate with the home network manager utilizing other network elements although a direct communication would be possible). The in an intermediate range condition may, for example, be associated with a condition where the integrated flood and temperature sensor 300 may not establish a direct connection with a home network manager (e.g., the home network manager 210) but may establish an indirect communication with the home network manager (e.g., through other network elements). The out of range indication may, for example be associated with a condition where the integrated flood and temperature sensor 300 may not be able to establish either a direct and/or in direct communication with a home network manager (e.g., the home network manager 210).

In an example embodiment of the disclosure, the wireless range tester 315 may indicate whether the integrated flood and temperature sensor 300 is in range (e.g., direct, indirect) and/or out of range through one or more audio and/or visual indicators (e.g., output 323, indicators 321). The indicators may be, for example, integrated with and/or external to the integrated flood and temperature sensor 300. For example, integrated flood and temperature sensor 300 may comprise an external visual indicator (e.g., LED, RGB, RGBW light) that may be operable to display the status of the integrated flood and temperature sensor 300 with respect to the range through different colors and/or illumination schemes. For example, a visual indicator may display a different color depending on the in-range status (e.g., one color may indicate that the integrated flood and temperature sensor 300 is in a direct range, a second color may indicate that the integrated flood and temperature sensor 300 is in indirect range and/or a third color may indicate that integrated flood and temperature sensor 300 is out of range). In another example, the visual indicator may blink at different frequencies, illuminate without blinking and/or be operable to display different illumination schemes depending on the in-range status of the integrated flood and temperature sensor 300.

The wired connection 317 may comprise a wired interface for connecting the integrated flood and temperature sensor 300 to external devices, such as a home network manager, utilizing a wired communications protocol, such as Ethernet. Similarly, the integrated flood and temperature sensor 300 may comprise a wireless transceiver 319, which may comprise suitable circuitry, logic, and/or code for communicating via one or more wireless communications protocols, such as Z-Wave, IEEE 802.11x, Bluetooth, and ZigBee. The wireless transceiver 319 may therefore comprise an RF front end, down-conversion/up-conversion capability, amplification, demodulation/modulation and other circuitry for transmission and reception of signals. In addition, the wireless transceiver 319 may be utilized to provide software/firmware updates to the integrated flood and temperature sensor 300.

In an example embodiment of the disclosure, the integrated flood and temperature sensor 300 may provide wired and/or wireless interfaces (through, for example, the wired connection 317 and/or wireless transceiver 319) that may enable one or more network devices to connect to a home network (e.g., home network 100) and/or home network manager (e.g., home network manager 210). For example, if the network manager provides connectivity of various devices to a home network, for example, based on a Z-Wave protocol, the integrated flood and temperature sensor 300 may, for example, contain suitable circuitry, interfaces, logic, and/or code that may enable a particular device that, for example, may not be compatible with the example Z-Wave protocol (and/or any other particular protocol that the network manager supports) to connect to the network manager and/or the home network. For example, the integrated flood and temperature sensor 300 may allow for monitoring of sensor devices that may otherwise be incompatible of being monitored on a particular home network and/or by a particular network manager.

The indicators 321 may comprise an array of light-emitting diodes (LEDs) or other light sources for indicating alarms and/or the status of the integrated flood and temperature sensor 300. In addition, the audio output 323 may comprise a speaker for generating sounds indicating a warning from and/or status of the integrated flood and temperature sensor 300.

The alarm system connection 325 may comprise a wired connection for the integrated flood and temperature sensor 300 to be coupled to a home alarm system. Alternatively, the integrated flood and temperature sensor 300 may communicate to a home alarm system wirelessly utilizing the wireless transceiver 319.

The remote probe connection 327 may comprise a wired connection to a remote probe, such as the remote probe 203B, for example, that enables water sensing at location remote to the integrated flood and temperature sensor 300. The DC input 329 may comprise an electrical connection for providing power to the integrated flood and temperature sensor 300 in conjunction with the battery 313.

The reset button 335 may be utilized to reset an alarm condition after the condition has been cleared. In an example scenario, the reset button 335 may be pressed for at least a specific amount of time before the alarm is reset.

The integrated flood and temperature sensor 300 may comprise one or more other buttons (and/or other interfaces) (not shown) either inside or outside of the integrated flood and temperature sensor 300 for providing basic functionality to the integrated flood and temperature sensor 300. For example, the integrated flood and temperature sensor 300 may comprise one or more buttons that may be pressed and/or depressed sequentially and/or for a predetermined and/or preconfigured about of time to operate one or more functions of the integrated flood and temperature sensor 300. One or more functions of the integrated flood and temperature sensor 300 may comprise range testing (e.g., whether the integrated flood and temperature sensor 300 is within a home network), connecting to a home network (e.g., paring between an integrated flood and temperature sensor 300 and a home network through, for example, a network manager) and/or temper prevention.

Figure 4:
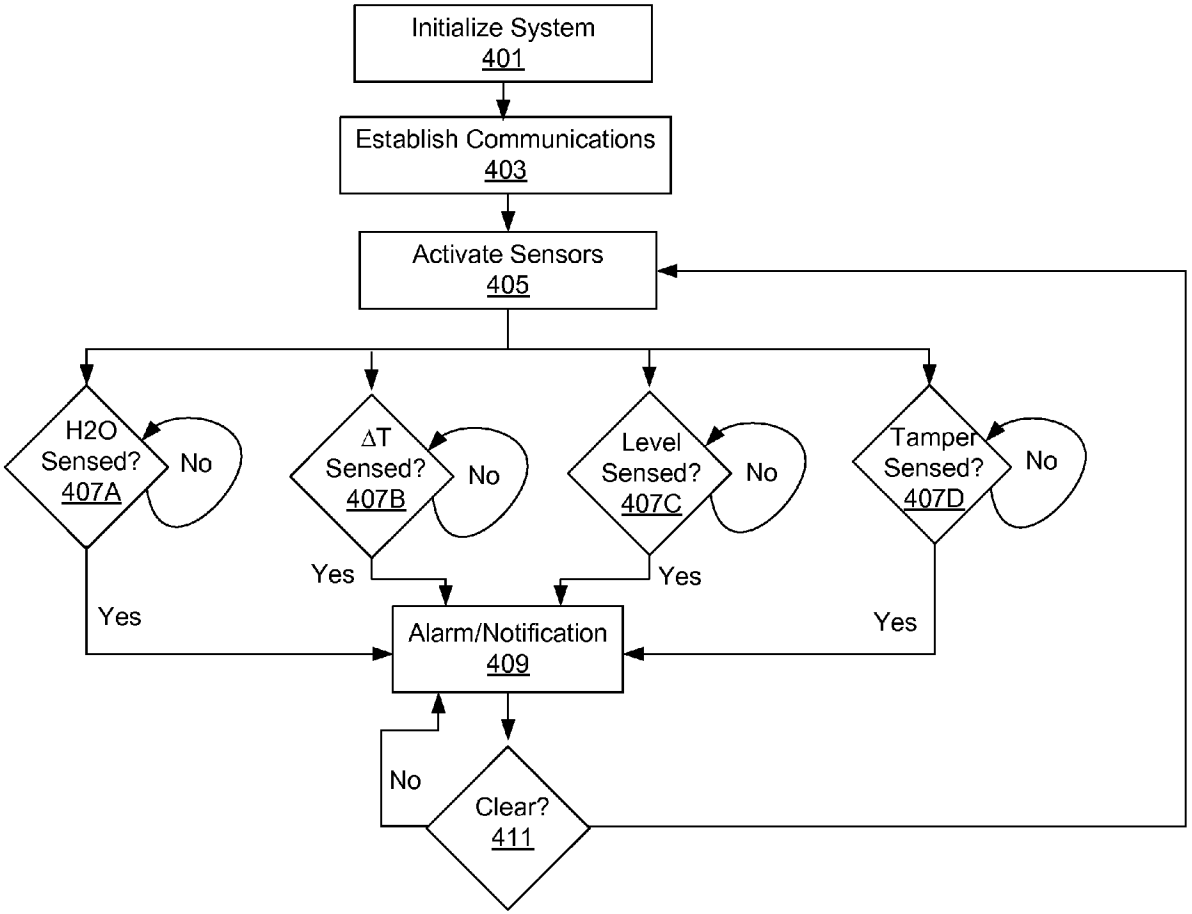
FIG. 4 is a flow diagram illustrating example steps in the operation of an integrated flood and temperature sensor, in accordance with an example embodiment of the disclosure.

FIG. 4 is a flow diagram illustrating example steps in the operation of an integrated flood and temperature sensor, in accordance with an example embodiment of the disclosure. The exemplary method illustrated in FIG. 4 may, for example, share any or all functional aspects discussed previously with regard to FIGS. 1-3.

Referring to FIG. 4, in step 401, the integrated flood and temperature sensor may be initialized upon power up or system reset. In step 403, communication links may be established with one or more devices utilizing one or more communications protocols. For example, the integrated flood and temperature sensor may establish a Z-Wave link to a home network manager.

In step 405, the integrated flood and temperature sensor may activate sensors, such as the flood sensor, temperature sensor, level sensor, and tamper sensor, for example. In step 407A-407D, if a measured reading exceeds a threshold value, the example steps may proceed to alarm/notification step 409. If no readings exceed the appropriate threshold, the example steps may remain in the sense steps 407A-407D. It should be noted that although steps 407A-407D are shown, indicating four separate sensing steps, any number of steps 407A-407D may be performed, depending on the number of sensors in the integrated flood and temperature sensor.

In alarm/notification step 409, visual and audio alarms may be activated and a notification may be sent to one or more external devices, such as a home network manager, an alarm system, and/or a mobile device of the home owner/resident.

In step 411, if the alarm condition is not cleared, the example steps may return to alarm/notification step 409. However, if the alarm condition is cleared, the example steps may proceed to step 405 where the sensors are again activated for normal sensing processes. In another example scenario, a reset process, such as holding a reset button for a predetermined time, may be utilized to reset the system and return to step 405. These process steps may be continuously repeated or on a recurring basis, depending on the power supply status, i.e., battery power only or with external DC input voltage, until a power down is executed.

In an embodiment of the invention, a method and system for an integrated flood and temperature sensor may comprise sensing a presence of water in a premises by measuring a resistance between at least one pair of the metal probes in an integrated flood and temperature sensor, sensing a temperature utilizing one or more temperature sensors in the integrated flood and temperature sensor, and sensing an orientation of the integrated flood and temperature sensor with respect to gravity utilizing one or more level sensors. The metal probes may be extendable from the integrated flood and temperature sensor.

The metal probes may be gold plated. A tamper sensor may sense whether an enclosure for the integrated flood and temperature sensor has been tampered with. The presence of water may be sensed utilizing a remote probe coupled to the integrated flood and temperature sensor. The integrated water and temperature sensor may communicate wirelessly with one or more external devices utilizing a wireless transceiver in the integrated flood and temperature sensor. The one or more external devices may comprise at least one of: a home network manager, an alarm system, a handheld communication device, and a personal computer. The integrated water and temperature sensor may communicate with the one or more external devices utilizing a Z-Wave communications protocol and/or a wired connection.

Other embodiments of the invention may provide a non-transitory computer readable medium and/or storage medium, and/or a non-transitory machine readable medium and/or storage medium, having stored thereon, a machine code and/or a computer program having at least one code section executable by a machine and/or a computer, thereby causing the machine and/or computer to perform the steps as described herein for an integrated flood and temperature sensor.

Accordingly, aspects of the invention may be realized in hardware, software, firmware or a combination thereof. The invention may be realized in a centralized fashion in at least one computer system or in a distributed fashion where different elements are spread across several interconnected computer systems. Any kind of computer system or other apparatus adapted for carrying out the methods described herein is suited. A typical combination of hardware, software and firmware may be a general-purpose computer system with a computer program that, when being loaded and executed, controls the computer system such that it carries out the methods described herein.

One embodiment of the present invention may be implemented as a board level product, as a single chip, application specific integrated circuit (ASIC), or with varying levels integrated on a single chip with other portions of the system as separate components. The degree of integration of the system will primarily be determined by speed and cost considerations. Because of the sophisticated nature of modern processors, it is possible to utilize a commercially available processor, which may be implemented external to an ASIC implementation of the present system. Alternatively, if the processor is available as an ASIC core or logic block, then the commercially available processor may be implemented as part of an ASIC device with various functions implemented as firmware.

The present invention may also be embedded in a computer program product, which comprises all the features enabling the implementation of the methods described herein, and which when loaded in a computer system is able to carry out these methods. Computer program in the present context may mean, for example, any expression, in any language, code or notation, of a set of instructions intended to cause a system having an information processing capability to perform a particular function either directly or after either or both of the following: a) conversion to another language, code or notation; b) reproduction in a different material form. However, other meanings of computer program within the understanding of those skilled in the art are also contemplated by the present invention.

While the invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiments disclosed, but that the present invention will include all embodiments falling within the scope of the appended claims.

What is claimed is:

1. A method of environmental sensing for use with a) a portable integrated flood and temperature sensor comprising an enclosure enclosing therein a range tester, a plurality of retractable metal probes each extendable from the interior of the enclosure such that a portion of each probe comes in contact with a surface exterior to the enclosure, a temperature sensor, and a level sensor, and b) a wireless network device remote from and being wirelessly connected to said portable integrated flood and temperature sensor, the method comprising:

measuring an electrical property at the surface with two or more of the plurality of retractable metal probes;

determining with the portable integrated flood and temperature sensor a presence of water on the surface from the measured electrical property;

sensing a temperature in the vicinity of said surface with the enclosed temperature sensor;

determining an orientation of the integrated flood and temperature sensor with respect to gravity with the enclosed level sensor to confirm that the orientation permits the plurality of retractable metal probes to make contact with the surface;

determining with the enclosed range tester if the wireless network device is in range of the range tester including transmitting a range testing signal from the range tester to the wireless network device;

in response to the wireless network device being in range of the range tester, receiving from the wireless network device a link for communication with the wireless network; and in response to receiving from the wireless network device the link for communication with the wireless network device, selectively generating a signal indicative of at least one of the determined presence of water, the temperature, and the determined orientation for communication with the wireless network device based on the link.

2. The method according to claim 1, wherein said portable integrated flood and temperature sensor further comprises a tamper sensor, the method further comprising sensing with the tamper sensor whether the enclosure has been tampered.

3. The method according to claim 1, wherein a plurality of remote probes are coupled to the portable integrated flood and temperature sensor, the method further comprising determining the presence of water via the plurality of remote probes.

4. The method according to claim 1, wherein said portable integrated flood and temperature sensor further comprises a wireless transceiver, the method further comprising communicating the generated signal wirelessly with the wireless network device via the wireless transceiver.

5. The method according to claim 4, wherein the wireless network device comprises at least one of: a home network manager, an alarm system, a handheld communication device, and a personal computer.

6. The method according to claim 5, further comprising communicating with the wireless network device utilizing a Z-Wave communications protocol.

7. The method according to claim 1, further comprising wirelessly communicating the measured electrical property from the plurality of retractable metal probes.

8. The method according to claim 1, wherein said selectively generating a signal further comprises generating at least one of an alarm signal and a visual signal, in response to determining that the orientation of the portable integrated flood and temperature sensor is not level.

9. The method according to claim 1, wherein said measuring an electrical property comprises measuring an impedance between the two or more of the plurality of retractable metal probes.

10. A portable environmental sensing device for use with a wireless network device, the portable environmental sensing device comprising:

an enclosure;

a plurality of retractable metal probes each extendable from the interior of the enclosure such that a portion of each probe comes in contact with a surface exterior to the enclosure, and configured to measure an electrical property at the surface between two or more of the retractable metal probes, and to determine a presence of water on the surface from the measured electrical property;

a temperature sensor, enclosed within the enclosure, and configured to measure a temperature near said portable environmental sensing device;

a level sensor, enclosed within the enclosure, and configured to determine an orientation of the portable integrated flood and temperature sensor with respect to gravity to confirm that the orientation permits the plurality of retractable metal probes to make contact with the surface;

a range tester, enclosed within the enclosure, and configured to determine if the wireless network device is in range of the range tester including transmitting a range testing signal from the range tester to the wireless network device;

a transceiver, enclosed within the enclosure, and configured to receive from the wireless network device a link for communication with the wireless network in response to the wireless network device being in range of the range tester; and a processor, enclosed within the enclosure, and configured to receive said determined presence of water, said temperature, and said sensed orientation, and, in response to receiving from the wireless network device the link for communication with the wireless network device, to selectively generate a signal indicative of at least one of the determined presence of water, the temperature, and the determined orientation for communication with the wireless network device based on the link.

11. The portable environmental sensing device according to claim 10, further comprising a tamper sensor configured to sense whether the enclosure has been tampered.

12. The portable environmental sensing device according to claim 10, wherein a plurality of remote probes are coupled to said processor.

13. The portable environmental sensing device according to claim 10, and wherein the wireless transceiver is further configured to communicate the generated signal wirelessly with the wireless network device.

14. The portable environmental sensing device according to claim 13, wherein the wireless network device comprises at least one of: a home network manager, an alarm system, a handheld communication device, and a personal computer.

15. The portable environmental sensing device according to claim 10, wherein the portable environmental sensing device is configured to wirelessly communicate the measured electrical property to the wireless network device.

16. The portable environmental sensing device according to claim 10, wherein the generated signal comprises at least one of an alarm signal and a visual signal, in response to said level sensor determining that the orientation of the environmental sensing device is not level.

17. The portable environmental sensing device according to claim 10, wherein said measured electrical property comprises an impedance.

18. A portable environmental sensing device for use with a wireless network device, the portable environmental sensing device comprising:

an enclosure;

a plurality of retractable metal probes each extendable from the interior of the enclosure such that a portion of each probe comes in contact with a surface exterior to the enclosure, and configured to measure an electrical property at the surface between two or more of the, and to determine a presence of water on the surface from the measured electrical property;

a temperature sensor, enclosed within the enclosure, and configured to measure a temperature near said portable environmental sensing device;

a level sensor, enclosed within the enclosure, and configured to determine an orientation of the portable integrated flood and temperature sensor with respect to gravity to confirm that the orientation permits the plurality of retractable metal probes to make contact with the surface;

a range tester, enclosed within the enclosure, and configured to determine if the wireless network device is in range of the range tester; and a transceiver, enclosed within the enclosure, and configured a) to transmit a range testing signal from the range tester to the wireless network device, b) to receive from the wireless network device a link for communication with the wireless network in response to the wireless network device being in range of the range tester, and, c) in response to receiving from the wireless network device a link for communication with the wireless network device, wirelessly communicate a message indicating a presence of water, a change in temperature above a threshold change, and/or and the determined orientation with the wireless network device based on the link.

* * * * *